United States Patent [19]

Funk et al.

[11] 4,293,790

[45] Oct. 6, 1981

[54] IMAGE CONVERTER HAVING CYLINDRICAL HOUSING AND PHOTOCATHODE SEPARATED BY SPACING ELEMENT FROM LUMINESCENT SCREEN ON FRUSTRUM

[75] Inventors: Hans-Wolfgang Funk, Hirschberg; Kurt Frank; Günter Flasche, both of Darmstadt, all of Fed. Rep. of Germany

[73] Assignee: Robert Bosch GmbH, Stuttgart, Fed. Rep. of Germany

[21] Appl. No.: 967,620

[22] Filed: Dec. 6, 1978

Related U.S. Application Data

[63] Continuation of Ser. No. 748,502, Dec. 18, 1976, abandoned.

[30] Foreign Application Priority Data

Dec. 10, 1975 [DE] Fed. Rep. of Germany ..... 2555438
Nov. 15, 1976 [DE] Fed. Rep. of Germany ..... 2652070

[51] Int. Cl.[3] ..... H01J 40/02; H01J 40/18

[52] U.S. Cl. ..... 313/101; 313/102; 313/95

[58] Field of Search ..... 313/94, 95, 99, 100, 313/101, 102, 96

[56] References Cited

U.S. PATENT DOCUMENTS

| | | | |
|---|---|---|---|
| 2,197,625 | 4/1940 | Teves et al. | 313/466 |
| 2,871,368 | 1/1959 | Bain | 313/95 X |
| 2,879,424 | 3/1959 | Garbuny et al. | 313/100 |
| 3,304,455 | 2/1967 | Mesta | 313/94 |
| 3,375,391 | 3/1968 | Day | 313/102 X |
| 3,392,297 | 7/1968 | Schwartz | 313/466 |
| 3,772,551 | 11/1973 | Grant | 313/95 X |
| 3,951,698 | 4/1976 | Wilson et al. | 313/94 X |

FOREIGN PATENT DOCUMENTS

| | | | |
|---|---|---|---|
| 351142 | of 1931 | United Kingdom | 313/99 |

*Primary Examiner*—Robert Segal
*Attorney, Agent, or Firm*—Michael J. Striker

[57] ABSTRACT

An image converter is disclosed which can be operated by means of a relatively low voltage D.C. supply. In this invention, the luminescent screen of the image converter is brought closer to the photocathode by forming the exit window with a frustrum-shaped platform with a top surface that is parallel to the entrance window, and upon which top surface the luminescent screen is mounted. As a result of the closer spacing between the photocathode and the luminescent screen, lower D.C. supply voltages can be utilized. Moreover, the shape of the housing which supports the two windows at the image converter is so designed that the interior surface of the housing is non-perpendicular to the equipotential lines of the electric field which is established between the photocathode and the luminescent screen. As a result of this geometrical relationship, avalanche discharge is reduced or eliminated altogether, thereby reducing or eliminating the undesirable arcing which can occur as a result of such avalanche discharge. Embodiments are taught for amplification of projected images in the visible portion of the electromagnetic spectrum, along with embodiments which can be utilized to form images of radioactive radiation, X-ray radiation and ultraviolet radiation.

8 Claims, 6 Drawing Figures

IMAGE CONVERTER HAVING CYLINDRICAL HOUSING AND PHOTOCATHODE SEPARATED BY SPACING ELEMENT FROM LUMINESCENT SCREEN ON FRUSTRUM

This is a continuation of application Ser. No. 748,502, filed Dec. 18, 1976, now abandoned.

BACKGROUND OF THE INVENTION

This invention pertains to image converters which can be used to convert non-visible radiation into visible images, and which can also be used to convert relatively weak projected images in the visible portion of the electromagnetic spectrum into amplified images of greater intensity. Such image converters conventionally utilize a photocathode upon which, either directly or indirectly, incident radiation can impinge, and from which photocathode electrons can be emitted in proportion to the amount of impinging radiation. Such image converters also conventionally utilize a luminescent screen which is maintained at a higher potential than the potential of the photocathode, in order to cause the electrons emitted from the photocathode to strike the luminescence screen and to thereby produce a visible image.

Conventionally, the photocathode is mounted on an entrance window, and the luminescent screen is mounted on an exit window. The exit window is made essentially transparent to the luminescence of the luminescent screen, in order to allow the image produced on the screen to be detected and subsequently utilized. In such image converters, the volume between these two windows may be evacuated.

In such image converters, it has been found that unintentional electron emission can cause avalanche discharge and can therefore cause arcing when the interior surface of the housing which supports the windows is perpendicular to the direction of equipotential lines of the electric field existing between the photocathode and the luminescent screen. Such arcing is undesirable.

Moreover, the bulkiness of some known image converters and the requirement that such image converters be supplied by more than one relatively high D.C. voltage supply makes such image converters difficult to use. It would therefore be advantageous to provide an image converter which required only one relatively low D.C. supply voltage for operation, and which would be so designed as to prevent arcing caused by avalanche discharge.

SUMMARY OF THE INVENTION

These objects, along with other which will appear hereinafter, are achieved by designing the housing which supports the windows of the invention in such a fashion that the interior surface of the housing is not perpendicular to the equipotential lines of the electric field which is established between the photocathode and the luminescent screen. By insuring that this non-perpendicular relationship exists, undesirable arcing caused by avalanche discharge is substantially reduced or eliminated altogether.

Additionally, this same objective can also be achieved by making the housing itself either weakly conductive or causing the non-conductive housing to have a weakly conductive coating. In either case, a weak conductive path having a resistance on the order $10^{10}$ to $10^{12}$ ohms is established between the photocathode and the luminescent screen.

Moreover, the distance between the photocathode and the luminescent screen can be reduced by providing the exit window, upon which the luminescent screen is mounted with a frustrum-shaped platform with an upper surface that is parallel to the windows. The platform extends towards the entrance window from the exit window. By mounting the luminescent screen on top of this platform and thus reducing the spacing between the photocathode and the luminescent screen, lower D.C. voltage supplies can be utilized.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
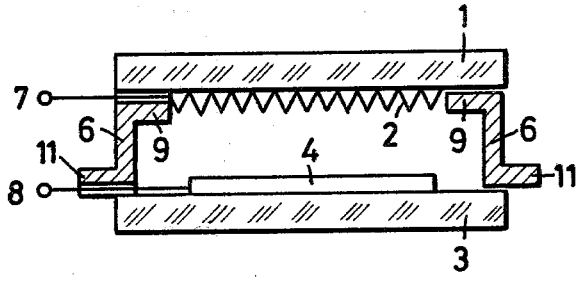
FIG. 1 depicts a first embodiment of the invention.

The image converter shown in FIG. 1 is formed as an evacuated receptacle having an entrance window 1. At the inner surface of the entrance window is a photocathode 2. An exit window 3 is also part of the receptacle, and has an inner surface provided with a luminescent screen 4. Intermediate the entrance window 1 and the exit window 3 is a spacing ring 6. The photocathode 2 and the luminescent screen 4 are electrically connected with terminals 7 and 8 respectively, across which a source of operating voltage may be connected.

The spacing ring 6 has, for example, a Z-, T- or L-shaped profile, so as to project radially inwardly at region 9 in the immediate vicinity of the entrance window 1. Region 9 deforms the potential field between the photocathode and the screen in such a manner as to prevent the occurrence of avalanche-type discharges around the inner surface of the spacing ring 6. Spacing ring 6 can have a radially outwardly extending annular projection 11 at its outer surface as is shown in FIG. 1, forming a generally Z-shaped profile; and avoiding shorts between terminals 7 and 8. For the same purpose, the leads connected to terminals 7 and 8 can be cast in an insulator.

An image to be amplified or converted is projected through the entrance window 1 onto the photocathode 2. Electrons are emitted from different locations of the photocathode 2 in dependence upon the electric charge established at those locations by corresponding portions of the projected image. Electrons emitted from the photocathode 2 bombard luminescent screen 4 as a result of the higher potential at which the luminescent screen 4 is maintained. An amplified or converted visible image which corresponds to the projected image thus appears on the luminescent screen 4. If additional image amplification is desired a micro-channel plate electron multiplier may be positioned intermediate the photocathode 2 and the luminescent screen 4.

Figure 2:
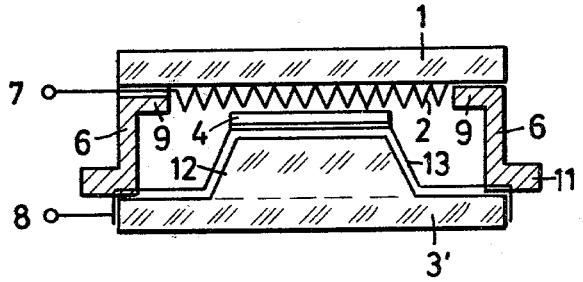
FIG. 2 depicts a second embodiment.

The image converter depicted in FIG. 2 has an exit window 3' which bears an elevated frustrum-shaped portion 12. This construction serves to further reduce the spacing between the photocathode 2 and luminescent screen 4, which latter is here located on the innermost surface of portion 12 of the exit window 3'. This reduced spacing makes it possible to use smaller operating voltages across terminals 7 and 8. These smaller voltages can be more readily furnished, making it possible to use this embodiment as a short-time shutter.

A metallic getter 13 is provided on the inner surface of the exit window 3'. The getter 13 is electrically connected with the innermost layer of luminescent screen 4. The innermost layer of screen 4 is both made of a material which is electrically conductive and transparent to light. A second layer 4, which contains the luminescent material of the screen, is placed on the innermost layer of screen 4. A third layer is provided atop the second layer and is made of blank aluminum. An outermost layer of porous black aluminum is vapor-deposited atop the third layer. The blank aluminum layer, =in a manner known per se, increases the light yield of the luminescent layer and thus of screen 4 as a whole. The porous black aluminum layer serves to absorb any light which manages to be transmitted through the photocathode 2, so as to prevent such light from falling upon the luminescent layer and brightening of layer portions which properly ought to be dark. In addition to these optical functions, these two aluminum layers can be made to serve an electrical function. By appropriately selecting the thicknesses of these two layers, incident electrons may be decelerated to bring their velocities down to a desired level; this is desirable when the amplification afforded by the image converter is to be made variable over a wide range by varying the electron velocity, without producing noticeable losses in resolution.

Figure 3:
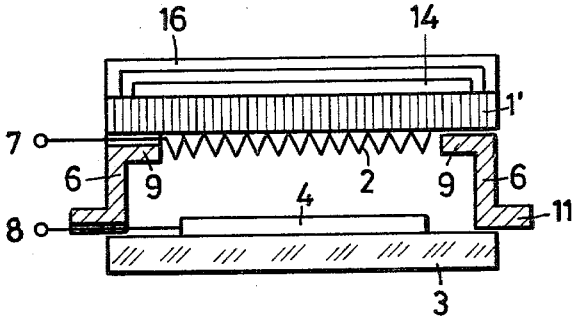
FIG. 3 depicts an image converter for converting roentgen radiation into visible light.

FIG. 3 depicts an image converter for X-rays. The converter of FIG. 3 has an entrance window 1' made up of a plurality of light-conductive filaments or fibers. Provided at the outer surface of the light-conductive filaments is a layer 14 of X-ray sensitive material. Layer 14, in turn, is externally covered by a layer 16 of a material which is opaque to visible light only. X-rays passing through the layer 16 fall upon layer 14, which latter produces a visible image corresponding to the incident X-ray image. This visible image is processed by the remainder of the image converter in the manner already explained with reference to FIG. 1.

Figure 4:
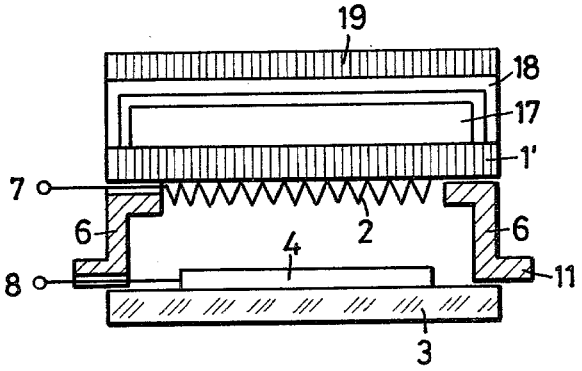
FIG. 4 depicts a scintillation image converter.

FIG. 4 depicts an image converter which converts radioactive radiation into visible light. To this end, a scintillation crystal 17 is placed in front of the light-conductive filaments of the entrance window 1'. Scintillation crystal 17 is protected from moisture by an encapsulating member 18 which is made of an optically opaque material. A perforated screen 19 is placed in front of the encapsulating member 18, and has a multitude of microfine channels, to ensure that only incident radiation normal to the image converter is actually converted into a visible image.

Radioactive radiation incident upon scintillation crystal 17 produces scintillations which are conducted to the photocathode 2 by the light-conductive filaments or fibers of the entrance window 1'. The photons incident upon photocathode 2 release electrons, leading to the formation of a visible image on luminescent screen 4 in the manner already explained with reference to FIG. 1.

If the entrance window 1 of the image converter shown in FIG. 1 or 2 is made of quartz glass rather than ordinary glass, then the image converter can be used for converting ultraviolet radiation into visible light.

Figure 5:
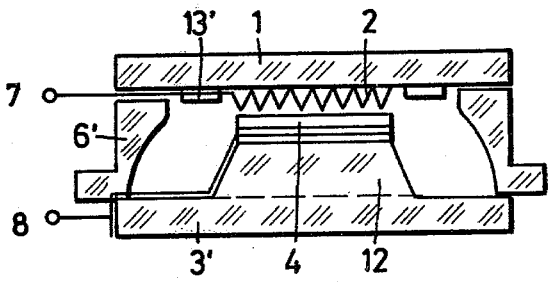
FIG. 5 depicts a different embodiment.
Figure 6:
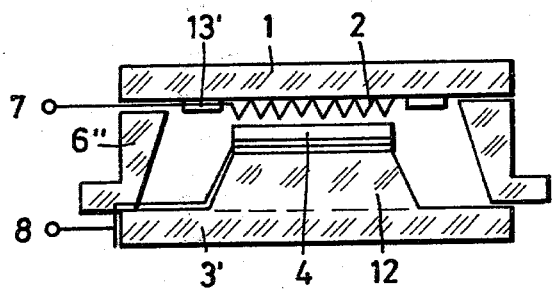
FIG. 6 depicts yet another embodiment.

In the embodiment depicted in FIGS. 5 and 6, the spacing ring 6' or 6'' is shaped to have, in the immediate vicinity of the entrance window 1, a radially inward projection. The transition from this smallest-diameter part of the ring 6' or 6'' to the larger-diameter part of the ring occurs gradually in both embodiments, and occurs linearly in the embodiment of FIG. 6. At the inner surface of the spacing ring, no released electrons can return to strike the inner surface and release secondary electrons. As before, avalanche discharge is avoided. Also, and again to prevent avalanche-type discharges, the spacing ring 6' or 6'' can, according to an important concept of the invention, be made of electrically conductive glass, or a non-conductive substrate covered by a weakly conductive layer, so that the resistance between the photocathode and the screen is between $10^{10}$ and $10^{12}$ Ohms.

In both FIGS. 5 and 6, an annular metallic getter 13 is located on the inner surface of the entrance window, and surrounds a circular photocathode 2. Advantageously, the spacing between the windows is less than one-fourth of their diameters.

It will be understood that each of the elements described above, or two or more together, may also find a useful application in other types of constructions differing from the types described above.

While the invention has been illustrated and described as embodied in image converters of particular geometry, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An image converter which is designed to prevent arcing caused by avalanche discharge from taking place during operation, comprising:

a flat and circular entrance window with an inner surface and an outer surface;

a flat and circular photocathode centered on and attached to the inner surface of the entrance window;

a flat and circular exit window with an inner surface and an outer surface and having a central frustum-shaped platform extending towards the entrance window;

a flat and circular luminescent screen centered on top of the platform and parallel to the windows and being sized substantially equally to the photocathode; and a hollow, unitary and generally cylindrical housing connected to the entrance window and the exit window in a manner that the windows are aligned and parallel to each other, the housing having an interior surface which is circular in cross-section and further having a minimum internal diameter adjacent the entrance window and the photocathode, a maximum internal diameter adjacent the exit window and an intermediate internal diameter which increases linearly between said minimum internal diameter and said maximum internal diameter, the diameters of the housing being such that avalanche discharge around the interior surface of the housing is minimized.

2. The image converter defined by claim 1, wherein the luminescent screen includes an innermost layer which is electrically conductive and transparent to light, a second layer located on top of the innermost layer and containing luminescent material, a third layer located on top of the second layer and made of blank aluminum, and an outermost layer located on top of the third layer and containing porous black aluminum which is vapor-deposited upon the third layer, and wherein the innermost layer is attached to the exit window.

3. The image converter defined by claim 2, further including a metal getter located on one of the inner surfaces.

4. The image converter defined by claim 3, wherein the getter is located on the inner surface of the entrance window.

5. The image converter defined by claim 1, wherein the housing is manufactured of electrically conductive glass, whereby weak conductivity between the photocathode and the screen is established.

6. The image converter defined by claim 1, wherein the interior surface of the housing is covered by an electrically conductive layer, whereby weak conductivity between the photocathode and the screen is established.

7. The image converter defined by claims 5 or 6, wherein the weak conductivity is on the order of $10^{10}$ to $10^{12}$ Ohms.

8. The image converter defined by claims 1, 5 or 6, wherein the windows are of like diameter, and wherein the windows are spaced apart from each other by a distance less than one-fourth of the diameter.

* * * * *